US009692183B2

(12) United States Patent
Phillips et al.

(10) Patent No.: US 9,692,183 B2
(45) Date of Patent: Jun. 27, 2017

(54) RECEPTACLE CONNECTOR WITH GROUND BUS

(71) Applicant: Tyco Electronics Corporation, Berwyn, PA (US)

(72) Inventors: Michael John Phillips, Camp Hill, PA (US); Matthew Ryan Schmitt, Middletown, PA (US); Bruce Allen Champion, Camp Hill, PA (US); Brandon Michael Matthews, McAlisterville, PA (US); Steve Douglas Sattazahn, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 79 days.

(21) Appl. No.: 14/600,542

(22) Filed: Jan. 20, 2015

(65) Prior Publication Data

US 2016/0211629 A1 Jul. 21, 2016

(51) Int. Cl.

| | |
|---|---|
| ***H01R 13/648*** | (2006.01) |
| ***H01R 13/6471*** | (2011.01) |
| *H01R 107/00* | (2006.01) |
| *H01R 12/72* | (2011.01) |

(52) U.S. Cl.

CPC ..... *H01R 13/6471* (2013.01); *H01R 12/724* (2013.01); *H01R 2107/00* (2013.01)

(58) Field of Classification Search

CPC ..... H01R 13/652; H01R 13/6597
USPC ..... 439/108, 637
See application file for complete search history.

(56) References Cited

U.S. PATENT DOCUMENTS

| | | | | |
|---|---|---|---|---|
| 3,399,372 | A * | 8/1968 | Uberbacher | H01R 12/721 439/101 |
| 3,587,029 | A * | 6/1971 | Knowles | H01R 13/6471 439/108 |
| 4,464,003 | A * | 8/1984 | Goodman | H01R 13/6593 439/404 |
| 4,824,383 | A * | 4/1989 | Lemke | H01R 24/60 439/108 |
| 4,975,069 | A * | 12/1990 | Fedder | H01R 12/775 439/101 |
| 6,019,616 | A * | 2/2000 | Yagi | H01R 13/65802 439/108 |
| 6,039,583 | A * | 3/2000 | Korsunsky | H01R 23/6873 439/101 |
| 6,210,182 | B1 * | 4/2001 | Elco | H01P 3/08 439/101 |
| 6,220,896 | B1 * | 4/2001 | Bertoncini | H01R 23/688 439/607.1 |

(Continued)

*Primary Examiner* — Neil Abrams

(57) ABSTRACT

A receptacle connector includes a housing having a slot configured to receive a mating connector therein. Signal contacts are held by the housing. The signal contacts include signal mating segments and signal mounting segments. The signal mating segments include signal mating interfaces that are exposed within the slot for engagement with the mating connector. Ground contacts are held by the housing. The ground contacts include ground mating segments and ground mounting segments. The ground mating segments include ground mating interfaces that are exposed within the slot for engagement with the mating connector. A ground bus electrically commons the ground contacts with each other. The ground contacts and the ground bus are integrally fabricated as a single, unitary, continuous structure.

20 Claims, 9 Drawing Sheets

(56) References Cited

U.S. PATENT DOCUMENTS 6,322,392 B1 * 11/2001 Wang ..... H01R 23/6873 439/101
6,464,537 B1 * 10/2002 Letourneau ..... H01R 12/714 439/108
6,743,057 B2 * 6/2004 Davis ..... H01R 23/688 439/607.05
6,780,059 B1 * 8/2004 Payne ..... H01R 12/57 439/607.39
6,832,933 B2 * 12/2004 Bu ..... H01R 12/721 439/637
6,890,193 B2 * 5/2005 Kimura ..... H01R 13/65802 439/108
7,128,611 B2 * 10/2006 Tanaka ..... H01R 31/06 439/108
7,134,912 B2 * 11/2006 Kamata ..... H01R 23/6873 439/607.31
7,311,532 B1 * 12/2007 Bippus ..... H01R 9/24 439/108
7,320,623 B2 * 1/2008 Hisamatsu ..... H01R 12/721 439/108
7,335,063 B2 * 2/2008 Cohen ..... H01R 13/514 439/108
7,438,601 B2 10/2008 Kobayashi
7,585,185 B2 * 9/2009 Obikane ..... H01R 13/65802 439/108
7,819,675 B2 * 10/2010 Ko ..... H01R 9/034 439/98
8,142,207 B1 * 3/2012 Ljubijankic ..... H01R 13/6473 439/95
8,167,631 B2 * 5/2012 Ito ..... H01R 24/38 439/108
8,177,564 B1 5/2012 Ito et al.
8,215,994 B2 * 7/2012 Duenas ..... H01R 13/6471 439/637
8,221,139 B2 * 7/2012 Qin ..... H01R 13/6471 439/92
8,277,258 B1 * 10/2012 Huang ..... H01R 31/08 439/497
8,342,886 B2 * 1/2013 Zhang ..... H01R 12/7005 439/660
8,353,726 B2 * 1/2013 Zhang ..... H01R 12/721 439/629
8,523,583 B2 * 9/2013 Ito ..... H01R 12/721 439/108
8,540,525 B2 * 9/2013 Regnier ..... H01R 29/00 439/79
8,545,240 B2 * 10/2013 Casher ..... H01R 29/00 439/108
8,764,460 B2 * 7/2014 Smink ..... H01R 13/6597 439/92
8,764,464 B2 7/2014 Buck et al.
8,764,488 B2 * 7/2014 Zeng ..... H01R 13/6585 439/108
8,801,464 B2 * 8/2014 McNamara ..... H01R 13/6461 439/607.07
8,858,243 B2 * 10/2014 Luo ..... H01R 13/652 439/108
8,944,849 B1 * 2/2015 Yang ..... H01R 13/6588 439/607.07
8,944,850 B2 * 2/2015 Simmel ..... H01R 43/20 439/607.55
8,992,262 B2 * 3/2015 Pang ..... H01R 13/6471 439/626
9,048,554 B2 * 6/2015 Tagawa ..... H01R 12/707
9,276,342 B2 * 3/2016 Masubuchi ..... H01R 12/775
9,337,585 B1 * 5/2016 Yang ..... H01R 13/6471
9,385,479 B1 * 7/2016 Schmitt ..... H01R 13/6471
9,385,482 B2 * 7/2016 Li ..... H01R 13/6585
9,401,570 B2 * 7/2016 Phillips ..... H01R 13/6585
9,431,768 B1 * 8/2016 Champion ..... H01R 13/6471
9,437,988 B2 * 9/2016 McGrath ..... H01R 24/60
9,455,530 B2 * 9/2016 Patel ..... H01R 13/652
9,509,098 B1 * 11/2016 Henry ..... H01R 13/6471
9,531,129 B2 * 12/2016 De Boer ..... H01R 13/6471
9,531,130 B1 * 12/2016 Phillips ..... H01R 13/6471
2004/0072467 A1 * 4/2004 Jordan ..... H01R 12/775 439/492
2012/0315796 A1 * 12/2012 Pang ..... H01R 13/6471 439/626
2015/0249309 A1 * 9/2015 Dandl ..... H01R 13/112 439/682
2015/0255904 A1 * 9/2015 Ito ..... H01R 12/721 439/88

* cited by examiner

RECEPTACLE CONNECTOR WITH GROUND BUS

BACKGROUND OF THE INVENTION

The subject matter described and/or illustrated herein relates generally to receptacle connectors.

Receptacle connectors are known for use in a variety of applications, such as, but not limited to, being mounted to a circuit board, for use within the host equipment that accepts a transceiver assembly, for terminating a jumper cable, and/or the like. Receptacle connectors typically include a slot that is configured to receive the plug of a mating connector therein. One or more rows of contacts are arranged within the slot for engagement with corresponding contacts of the mating connector. The contacts may be arranged in differential pairs of signal contacts, with ground contacts extending between the differential pairs in a ground-signal-signal-ground (G-S-S-G) pattern of the contacts.

Known receptacle connectors are not without disadvantages. For example, the signal contacts may exhibit undesirable resonant frequency noise spikes if the ground contacts are not electrically commoned. Ground bars or the like may therefore be used to electrically common the ground contacts together. But, known ground bars are connected to the ground contacts with beams that engage the ground contacts at a separable interface, which may cause difficulty controlling the mating normal force between the receptacle and mating connectors. Moreover, the separable interface between the ground bus and the ground contacts may be unreliable.

BRIEF DESCRIPTION OF THE INVENTION

In an embodiment, a receptacle connector includes a housing having a slot configured to receive a mating connector therein. Signal contacts are held by the housing. The signal contacts include signal mating segments and signal mounting segments. The signal mating segments include signal mating interfaces that are exposed within the slot for engagement with the mating connector. Ground contacts are held by the housing. The ground contacts include ground mating segments and ground mounting segments. The ground mating segments include ground mating interfaces that are exposed within the slot for engagement with the mating connector. A ground bus electrically commons the ground contacts with each other. The ground contacts and the ground bus are integrally fabricated as a single, unitary, continuous structure.

In an embodiment, a receptacle connector includes a housing having a slot configured to receive a mating connector therein. Signal contacts are held by the housing. The signal contacts include signal mating segments and signal mounting segments. The signal mating segments include signal mating interfaces that are exposed within the slot for engagement with the mating connector. Ground contacts are held by the housing. The ground contacts include ground mating segments and ground mounting segments. The ground mating segments include ground mating interfaces that are exposed within the slot for engagement with the mating connector. A first ground bus electrically commons the ground mating segments of the ground contacts with each other. The ground mating segments and the first ground bus are integrally fabricated as a single, unitary, continuous structure. A second ground bus electrically commons the ground mounting segments of the ground contacts with each other. The ground mounting segments and the second ground bus are integrally fabricated as a single, unitary, continuous structure.

In an embodiment, a receptacle connector includes a housing having a slot configured to receive a mating connector therein. Signal contacts are held by the housing. The signal contacts are arranged in differential pairs. The signal contacts include signal mating segments and signal mounting segments. The signal mating segments include signal mating interfaces that are exposed within the slot for engagement with the mating connector. Ground contacts are held by the housing. The ground contacts include ground mating segments and ground mounting segments. The ground mating segments include ground mating interfaces that are exposed within the slot for engagement with the mating connector. A ground bus electrically commons the ground contacts with each other. The ground contacts and the ground bus are integrally fabricated as a single, unitary, continuous structure. Alternating differential pairs of the signal contacts are routed over and under the ground bus.

DETAILED DESCRIPTION OF THE INVENTION

Figure 1:
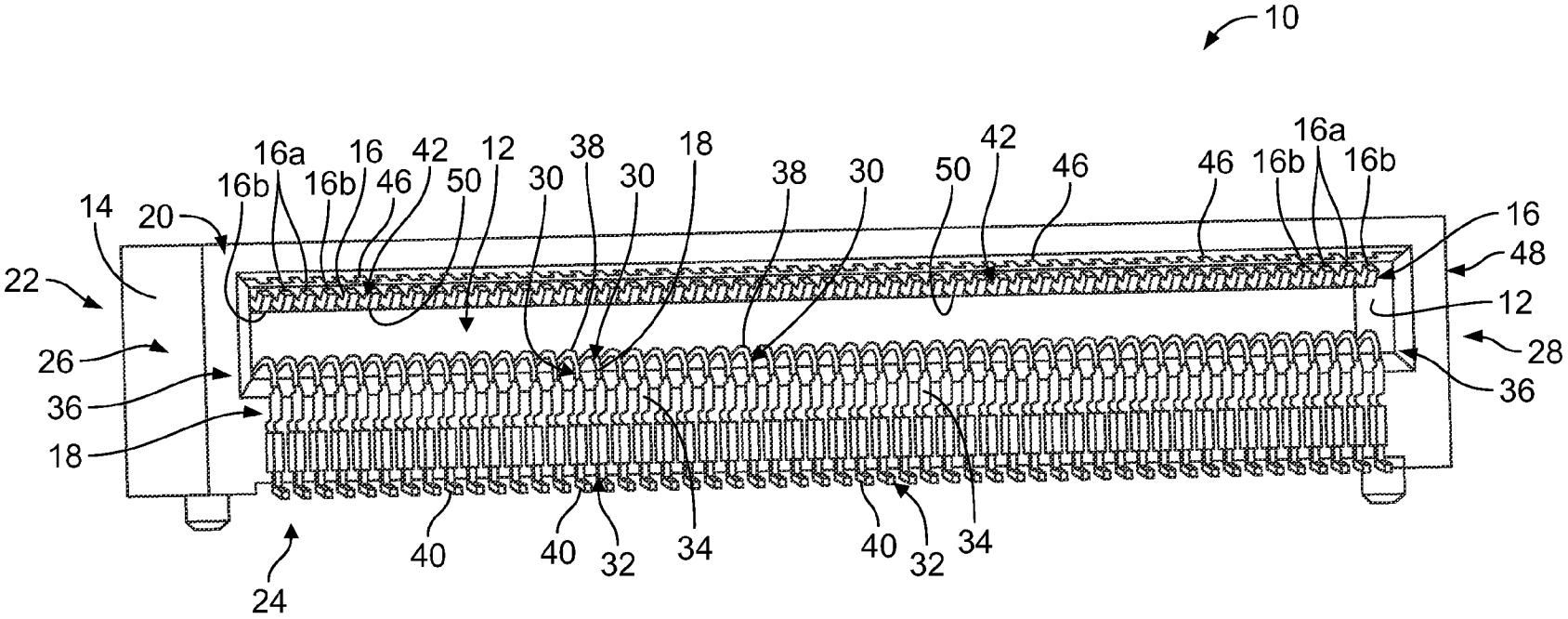
FIG. 1 is a front perspective view of an embodiment of a receptacle connector.

FIG. 1 is a front perspective view of an embodiment of a receptacle connector 10. The receptacle connector 10 is configured to mate with a mating connector (not shown) to establish and electrical connection between the receptacle connector 10 and the mating connector. Specifically, the receptacle connector 10 includes a slot 12 that is configured to receive a plug (not shown) of the mating connector therein. The plug may have any structure, such as, but not limited to, the edge of a circuit board, an electrical connector (e.g., a straddle mount connector that mounts to an edge of a circuit board), and/or the like. The receptacle connector 10 may be used in any application. Non-limiting examples of applications of the receptacle connector 10 include, but are not limited to, being mounted to a circuit board (not shown), for use within host equipment (not shown) of a transceiver assembly (not shown), for terminating a cable (not shown), and/or the like.

The receptacle connector 10 includes a housing 14 having the slot 12. The receptacle connector 10 includes a group of contacts 16 and a group of contacts 18. The contacts 16 extend within the slot 12 and engage corresponding contacts (not shown) that extend on a first side of the plug of the mating connector. For example, the contacts 16 may engage corresponding contact pads that extend on a first side of a circuit board of the mating connector. The contacts 18 also extend within the slot 12 for engagement with corresponding contacts (not shown) that extend on a second side of the plug of the mating connector that is opposite the first side (e.g., corresponding contact pads that extend on an opposite second side of a circuit board of the mating connector). Engagement between the contacts 16 and 18 and the corresponding contacts of the mating connector establishes an electrical connection between the receptacle connector 10 and the mating connector. The group of contacts 16 optionally may be considered a contact overmolded sub-assembly of the receptacle connector 10 (e.g., when the carrier 54 is molded over the contacts 16).

The housing 14 of the receptacle connector 10 extends from a front end 20 to a rear end 22 and includes a bottom side 24. In the illustrated embodiment of the housing 14, the housing 14 is configured to be mounted to a circuit board (not shown) at the bottom side 24. The front end 20 of the housing 14 includes the slot 12. More particularly, the slot 12 extends through the front end 20 and into the housing 14 toward the rear end 22. The slot 12 optionally extends through one or both opposite sides 26 and 28 of the housing 14.

The contacts 18 of the receptacle connector 10 are held by the housing 14 and include mating segments 30 and mounting segments 32. Optionally, the housing 14 includes a plurality of grooves 34 that receive corresponding contacts 18 therein. The grooves 34 may facilitate holding the contacts 18 in position relative to one another (e.g. side-to-side position). The mating segments 30 of the contacts 18 are arranged within a row 36 and extend within the slot 12. The mating segments 30 of the contacts 18 include mating interfaces 38 that are exposed within the slot 12 for engagement with the corresponding contacts of the mating connector.

Optionally, and as can be seen in FIG. 1, the mounting segments 32 of the contacts 18 extend along the front end 20 of the housing 14. In the illustrated embodiment of the contacts 18, the mounting segment 32 of each contact 18 includes a mounting foot 40 that is configured to be surface mounted to a circuit board. More particularly, the mounting feet 40 are configured to be mounted on corresponding contact pads (not shown) on the circuit board in electrical connection therewith. In other embodiments, the mounting segment 32 of one or more of the contacts 18 is mounted on the circuit board using another type of mounting than surface mounting, such as, but not limited to, using a compliant pin (instead of the mounting foot 40) that is received within a via (not shown) of the circuit board. Moreover, the mounting segment 32 of one or more of the contacts 18 may be configured to terminate a corresponding conductor (not shown) of a cable (not shown).

The receptacle connector 10 may include any number of the contacts 18. Each of the contacts 18 may be a signal contact, a ground contact, or a power contact. Optionally, some or all contacts 18 used as signal contacts may be arranged in pairs with each signal contact within a pair conveying a differential signal, thus defining one or more differential pairs. Within the arrangement of the contacts 18, one or more ground contacts may be provided between adjacent differential pairs of signal contacts. Any other contact arrangement of the contacts 18 may be provided.

The housing 14 of the receptacle connector 10 also holds the contacts 16. The contacts 16 include mating segments 42 and mounting segments 44 (shown in FIG. 2). Optionally, the housing 14 includes a plurality of grooves 46 that receive the mating segments 42 of corresponding contacts 16 therein. The grooves 46 may facilitate holding the mating segments 42 of the contacts 16 in position relative to one another (e.g. side-to-side position). The mating segments 42 of the contacts 16 are arranged within a row 48 and extend within the slot 12. The mating segments 42 of the contacts 16 include mating interfaces 50 that are exposed within the slot 12 for engagement with the corresponding contacts of the mating connector.

The receptacle connector 10 may include any number of the contacts 16. The contacts 16 include signal contacts **16*a* and ground contacts 16*b*. In the illustrated embodiment of the contacts 16, the signal contacts 16*a* are arranged in pairs with each signal contact 16*a* within a pair conveying a differential signal, thus defining one or more differential pairs. Within the arrangement of the contacts 16, one or more ground contacts 16*b* are provided between adjacent differential pairs of signal contacts 16*a*. Any other contact arrangement of the contacts 16 may be provided. The mating segments 42 and the mounting segments 44 of the signal contacts 16*a* may be referred to herein as "signal mating segments" and "signal mounting segments", respectively. The mating segments 42 and the mounting segments 44 of the ground contacts 16*b* may be referred to herein as "ground mating segments" and "ground mounting segments", respectively. The mating interfaces 50 of the signal contacts 16*a* and the ground contacts 16*b*** may be referred to herein as "signal mating interfaces" and "ground mating interfaces", respectively.

Figure 2:
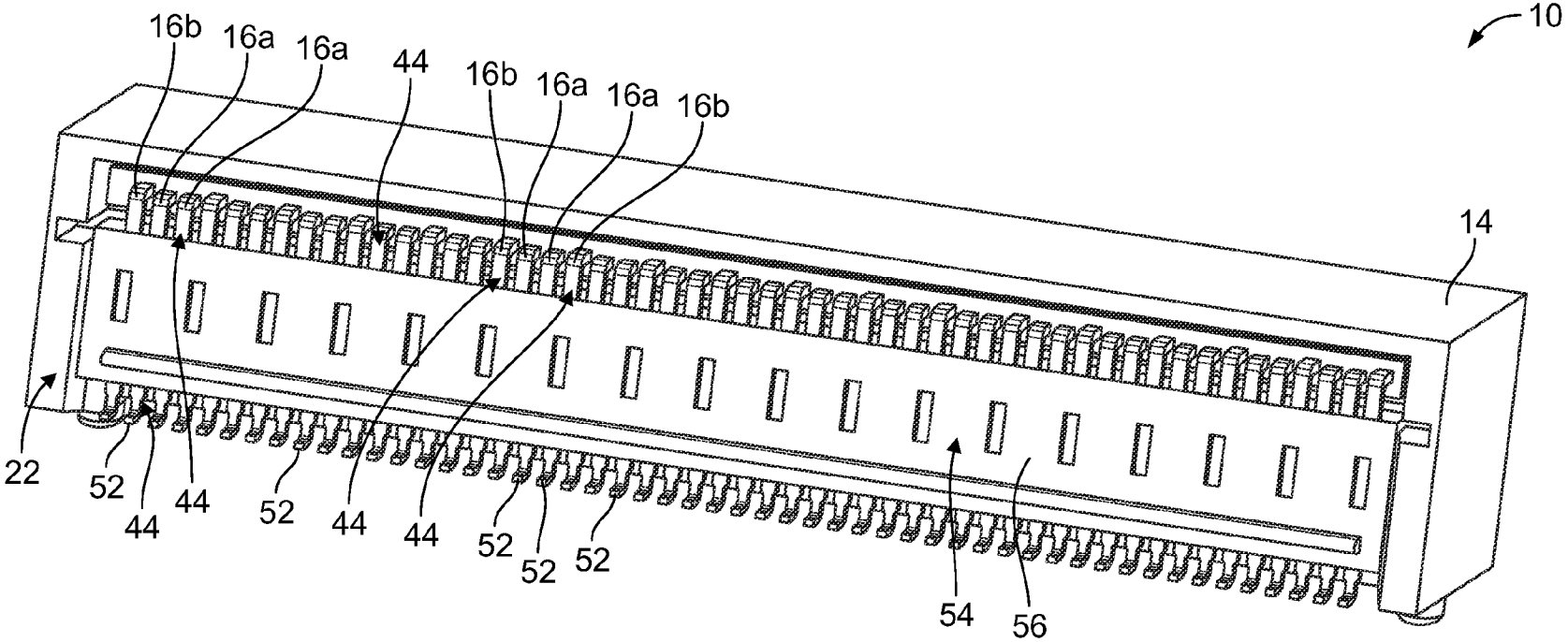
FIG. 2 is a rear perspective view of the receptacle connector shown in FIG. 2.

FIG. 2 is a rear perspective view of the receptacle connector 10 illustrating the rear end 22 of the housing 14 of the receptacle connector 10. As can be seen in FIG. 2, the mounting segments 44 of the contacts 16 extend along the rear end 22 of the housing 14. In the illustrated embodiment of the contacts 16, the mounting segment 44 of each contact 16 includes a mounting foot 52 that is configured to be surface mounted to a circuit board. More particularly, the mounting feet 52 are configured to be mounted on corresponding contact pads (not shown) on the circuit board in electrical connection therewith. In other embodiments, the mounting segment 44 of one or more of the contacts 16 is mounted on the circuit board using another type of mounting than surface mounting, such as, but not limited to, using a compliant pin (instead of the mounting foot 52) that is received within a via (not shown) of the circuit board. Moreover, the mounting segment 44 of one or more of the contacts 16 may be configured to terminate a corresponding conductor of a cable.

Figure 3:
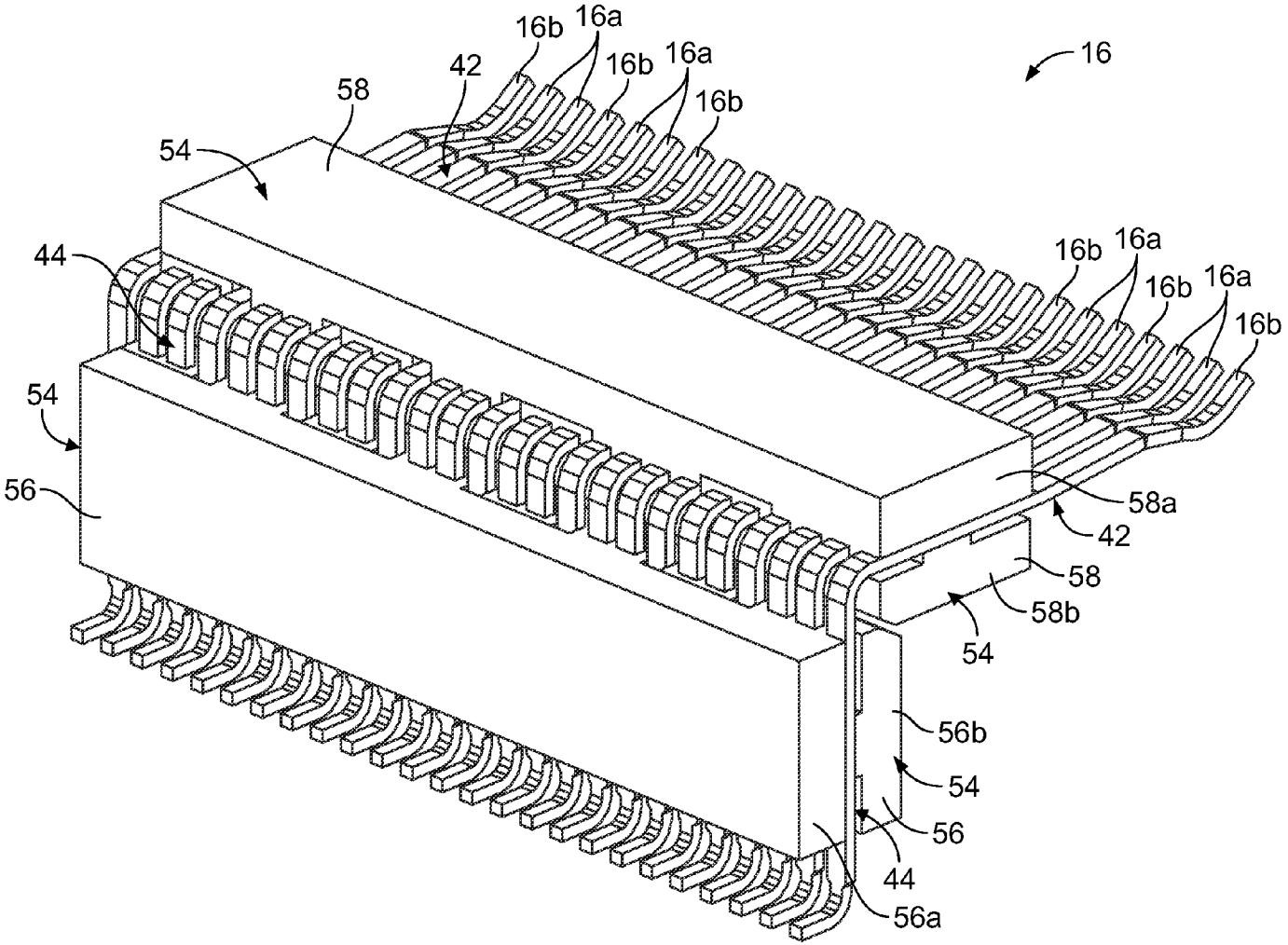
FIG. 3 is a perspective view of an embodiment of an assembly of a group of contacts of the receptacle connector shown in FIGS. 1 and 2.

FIG. 3 is a perspective view of an embodiment of an assembly of the contacts 16 of the receptacle connector 10 (shown in FIGS. 1 and 2). In the illustrated embodiment of the contacts 16, the contacts 16 are held by a common dielectric carrier 54 that is held by the housing 14 (shown in FIGS. 1 and 2), for example as is shown in FIG. 2. In the illustrated embodiment of the receptacle connector 10, the carrier 54 includes a segment 56 that holds the mounting segments 44 of the contacts 16 and a segment 58 that holds the mating segments 42 of the contacts 16, with the segments 56 and 58 being separate from (i.e., not connected to) each other. The carrier 54 may include any number of segments, each of which may or may not be connected to one or more other segments of the carrier 54. The segment 56 of the carrier 54 is visible in FIG. 2. In the illustrated embodiment of the carrier 54, each segment 56 and 58 includes two pieces 56*a*, 56*b* and 58*a*, 58*b*, respectively, that form the respective segment 56 and 58, but each segment 56 and 58 may include any number of pieces. The various segments 56 and 58 and pieces 56*a*, 56*b*, 58*a*, and 58*b* are optionally overmolded to the contacts 16. In other embodiments, the receptacle connector 10 does not include the carrier 54 and the contacts 16 are held directly by the housing 14 of the receptacle connector 10 (e.g., the contacts 116 of the embodiment of the receptacle connector 110 shown in FIG. 6).

As can be seen in FIG. 3, the signal contacts 16*a* are arranged in the differential pairs, with ground contacts 16*b* provided between adjacent differential pairs of signal contacts 16*a*. In the illustrated embodiment of the contacts 16, a single ground contact 16*b* is provided between adjacent differential pairs of the signal contacts 16*a* such that the contacts 16 have a ground-signal-signal-ground-signal-signal-ground (G-S-S-G-S-S-G) pattern of the contacts 16. But, any number of ground contacts 16*b* may extend between adjacent differential pairs of the signal contacts 16*a*.

Figure 4:
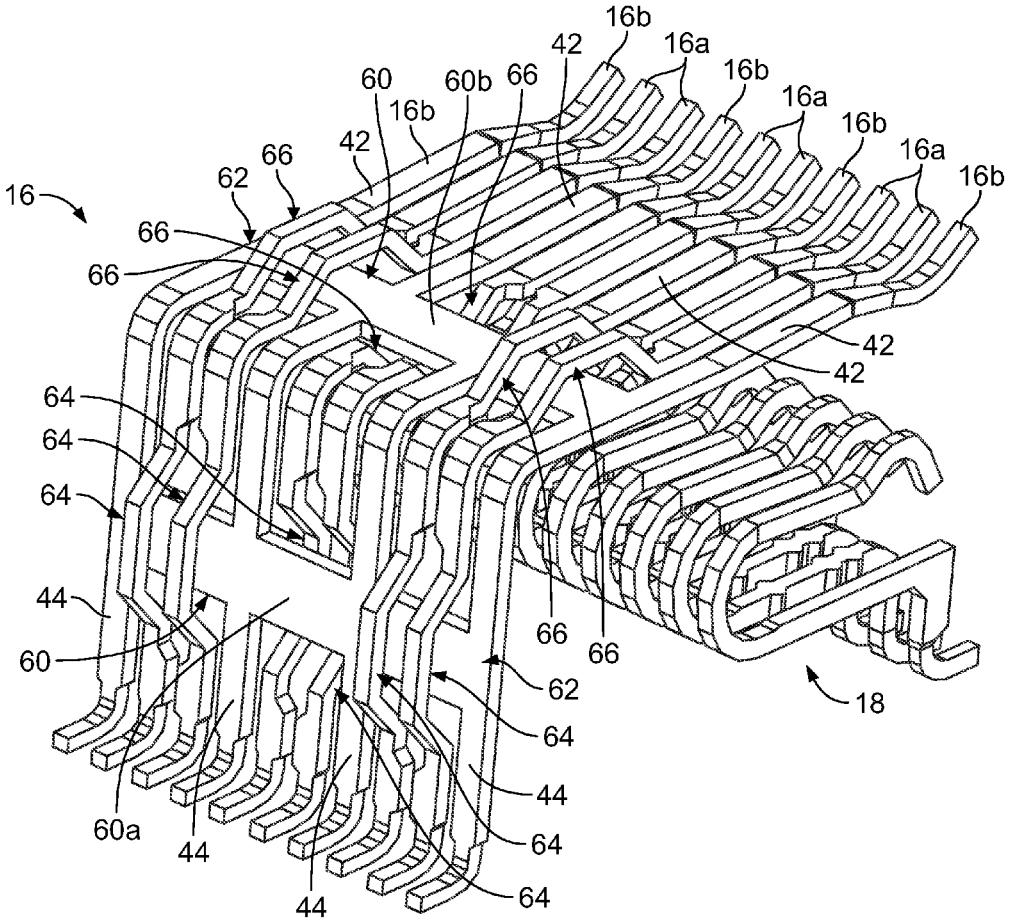
FIG. 4 is a perspective view of a portion of an embodiment of an assembly of the contacts of the receptacle connector shown in FIGS. 1 and 2.

FIG. 4 is a perspective view of a portion of an embodiment of an assembly of the contacts 16 and 18. Only some of the contacts 16 and only some of the contacts 18 are shown in FIG. 4 for clarity. The carrier 54 (shown in FIGS. 2, 3, and 5) has been removed from the contacts 16 in FIG. 4 for clarity. As shown in FIG. 4, one or more ground buses 60 are provided to electrically common the ground contacts 16*b* with each other. In other words, each ground bus 60 provides a continuous electrical pathway from any one ground contact 16*b* to all other ground contacts 16*b*. In the illustrated embodiment of the contacts 16, two ground buses 60*a* and 60*b* are provided. But, any other number of ground buses 60 may be provided. In some embodiments, only a single ground bus 60 (e.g., the ground bus 60*a* or the ground bus 60*b*) is provided.

The ground bus 60*a* extends between, and thereby interconnects, the mounting segments 44 of the ground contacts 16*b* such that the ground bus 60*a* electrically commons the mounting segments 44 of the ground contacts 16*b* to each other. In other words, the ground bus 60*a* extends from the mounting segment 44 of any one ground contact 16*b* to the mounting segment 44 of each adjacent ground contact 16*b*. Although only some of the ground contacts 16*b* are shown in FIG. 4, it should be understood that in the illustrated embodiment of the ground contacts 16*b*, the ground bus 60*a* extends between, and thereby interconnects, the mounting segments 44 of each of the ground contacts 16*b*. In other embodiments, the ground bus 60*a* extends between, and thereby interconnects, the mounting segments 44 of only some of the ground contacts 16*b*.

Although shown as extending at an approximate midpoint of the lengths of the mounting segments 44 of the ground contacts 16*b*, the ground bus 60*a* additionally or alternatively may extend at any other location(s) along the lengths of the mounting segments 44 of the ground contacts 16*b*. Moreover, although the ground bus 60*a* is shown as extending approximately perpendicular to the lengths of the mounting segments 44 of the ground contacts 16*b*, the ground bus 60*a* additionally or alternatively may extend at any other angle relative to the lengths of the mounting segments 44 of the ground contacts 16*b*. The ground bus 60*a* may be referred to herein as a "first" and/or a "second" ground bus.

The ground bus 60*a* may improve the electrical performance of the receptacle connector 10. For example, the ground bus 60*a* may reduce the occurrence of undesirable resonant frequency noise spikes, may cancel and/or reduce signal noise, may improve inter-pair signal skew, may match and/or provide a predetermined impedance, and/or the like.

The ground bus 60*b* extends between, and thereby interconnects, the mating segments 42 of the ground contacts 16*b* (i.e., the ground bus 60*b* extends from the mating segment 42 of any one ground contact 16*b* to the mating segment 42 of each adjacent ground contact 16*b*) such that the ground bus 60*b* electrically commons the mating segments 42 of the ground contacts 16*b* to each other. Despite only some of the ground contacts 16*b* are shown in FIG. 4, it should be understood that in the illustrated embodiment of the ground contacts 16*b*, the ground bus 60*b* extends between, and thereby interconnects, the mating segments 42 of each of the ground contacts 16*b*. In other embodiments, the ground bus 60*b* extends between, and thereby interconnects, the mating segments 42 of only some of the ground contacts 16*b*.

In addition or alternative to the illustrated location of the ground bus 60*b* along the lengths of the mating segments 42 of the ground contacts 16*b*, the ground bus 60*b* may extend at any other location(s) along the lengths of the mating segments 42 of the ground contacts 16*b*. Although shown as extending approximately perpendicular to the lengths of the mating segments 42 of the ground contacts 16*b*, the ground bus 60*b* additionally or alternatively may extend at any other angle relative to the lengths of the mating segments 42 of the ground contacts 16*b*. The ground bus 60*b* may be referred to herein as a "first" and/or a "second" ground bus.

The ground bus 60*b* may improve the electrical performance of the receptacle connector 10. For example, the ground bus 60*b* may reduce the occurrence of undesirable resonant frequency noise spikes, may cancel and/or reduce signal noise, may improve inter-pair signal skew, may match and/or provide a predetermined impedance, and/or the like.

The ground contacts 16*b* and the ground buses 60*a* and 60*b* are integrally fabricated from the same sheet of material as a single, unitary, continuous structure such that the ground contacts 16*b* and the ground buses 60*a* and 60*b* define a single, unitary lead frame 62. One example of a process for integrally fabricating the ground contacts 16*b* and the ground buses 60*a* and 60*b* from the same sheet of material as a continuous structure includes cutting the ground contacts 16*b* and the ground buses 60*a* and 60*b* from a sheet of material and forming the cut structure into the finished shape of the lead frame 62 shown herein. Any cutting process(es) may be used to fabricate the lead frame 62 as a cut and formed lead frame, such as, but not limited to, stamping, laser cutting, water cutting, plasma cutting, cutting using a cutting tool (e.g., a saw, a blade, and/or the like), and/or the like. Moreover, any forming process(es) may be used to fabricate the lead frame 62 as a cut and formed lead frame, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the lead frame 62 is a stamped and formed lead frame that is stamped from a sheet of material. In such embodiments wherein the lead frame 62 is a stamped and formed lead frame, any other type and/or number of forming methods optionally may be used in addition to the stamping process(es) to fabricate the lead frame 62 as a stamped and formed lead frame 62.

Integrally fabricating the ground contacts 16*b* and the ground buses 60*a* and 60*b* from the same sheet of material as a single, unitary, continuous structure, for example using a cutting and forming process, eliminate a separable interface between the ground contacts 16*b* and the ground buses 60*a* and 60*b*, which may enable greater control of the mating normal force between the receptacle connector 10 and the mating connector. Moreover, eliminating a separable interface between the ground contacts 16*b* and the ground buses 60*a* and 60*b* may improve the reliability of the receptacle connector 10.

Figure 5:
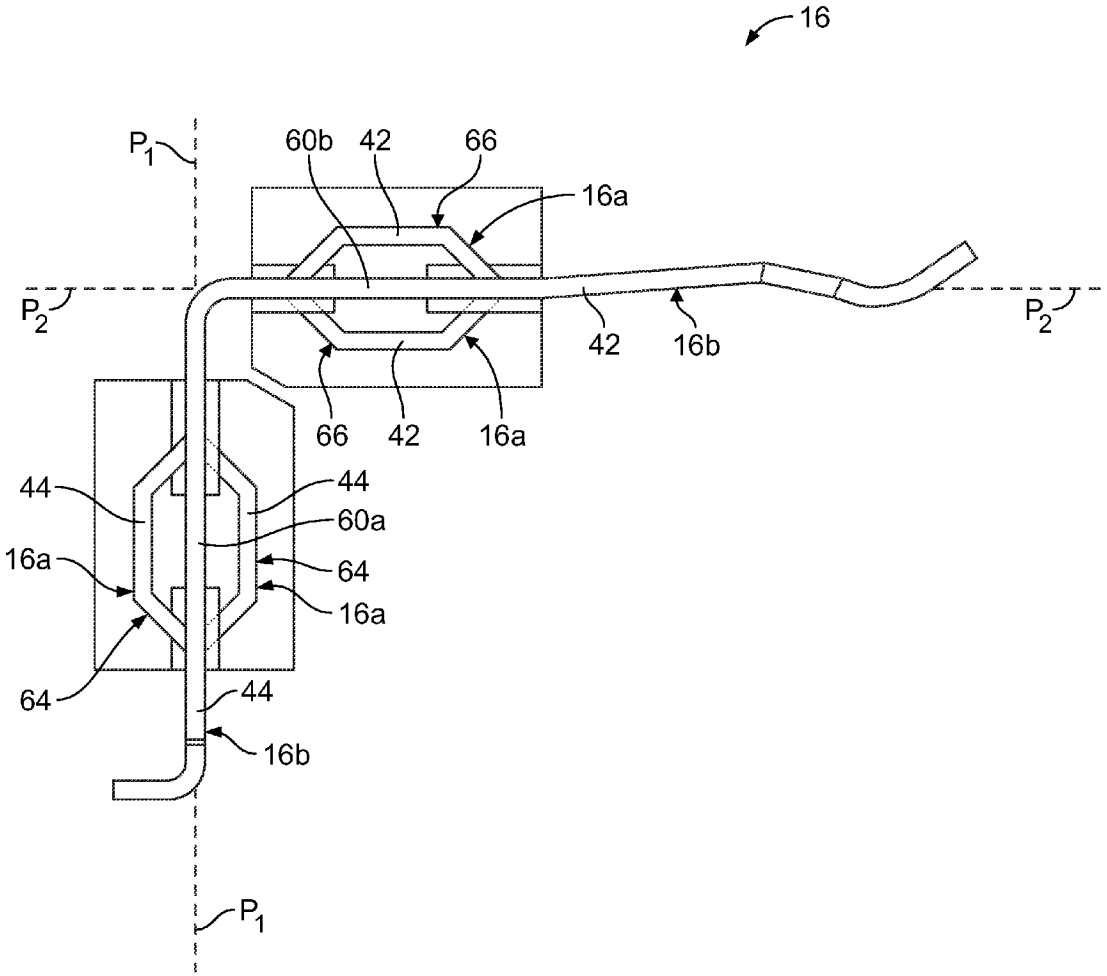
FIG. 5 is a cross-sectional view of the assembly of the group of contacts shown in FIG. 3.

FIG. 5 is a cross-sectional view of the assembly of the contacts 16 shown in FIG. 3. Referring now to FIGS. 4 and 5, in the illustrated embodiment, the mounting segments 44 of the signal contacts 16*a* are arranged in approximately the same plane $P_1$ (not labeled in FIG. 4) as the mounting segments 44 of the ground contacts 16*b*, as can be seen in FIGS. 4 and 5. Similarly, the mating segments 42 of the signal contacts 16*a* are arranged in approximately the same plane $P_2$ (not labeled in FIG. 4) as the mating segments 42 of the ground contacts 16*b*.

The mounting segments 44 and the mating segments 42 of the signal contacts 16*a* are offset from the respective ground buses 60*a* and 60*b* to prevent the signal contacts 16*a* from electrically shorting with the ground buses 60*a* and 60*b*. Specifically, the mounting segments 44 and the mating segments 42 are offset from the respective planes $P_1$ and $P_2$ of the respective mounting segments 44 and mating segments 42 at the locations of the respective ground buses 60*a* and 60*b*. In the illustrated embodiment of the contacts 16, the mounting segments 44 of alternating differential pairs of the signal contacts 16*a* are routed over and under the ground bus 60*a*, as best seen in FIG. 4. In other words, the mounting segments 44 of one differential pair of two adjacent differential pairs of the signal contacts 16*a* is routed over the ground bus 60*a* and the mounting segments 44 of the other differential pair of the two adjacent differential pairs is routed under the ground bus 60*a*. As shown in both FIGS. 4 and 5, routing of a differential pair either over or under the ground bus 60*a* is accomplished by jogs 64 of the mounting segments 44 of the signal contacts 16*a* that offset the mounting segments 44 of the signal contacts 16*a* from the ground bus 60*a*. Each differential pair of two adjacent differential pairs of the signal contacts 16*a* may be referred to herein as a "first" and/or a "second" differential pair.

Although the mounting segments 44 of alternating differential pairs of the signal contacts 16*a* are routed over and under the ground bus 60*a* as shown herein and described above, the receptacle connector 10 (shown in FIGS. 1 and 2) is not limited to such an alternating pattern. Rather, all of the mounting segments 44 of the signal contacts 16*a* could be routed over the ground bus 60*a*, all of the mounting segments 44 of the signal contacts 16*a* could be routed under the ground bus 60*a*, or a different pattern of the mounting segments 44 of the signal contacts 16*a* could be routed over and under the ground bus 60*a*. The alternating pattern of the mounting segments 44 of the signal contacts 16*a* over and under the ground bus 60*a* may improve the electrical performance of the receptacle connector 10, such as, but not limited to, by reducing the occurrence of electrical coupling between adjacent differential pairs of the signal contacts 16*a* and/or the like.

In the illustrated embodiment of the contacts 16, the mating segments 42 of alternating differential pairs of the signal contacts 16*a* are routed over and under the ground bus 60*b*. In other words, the mating segments 42 of a first differential pair of two adjacent differential pairs of the signal contacts 16*a* is routed over the ground bus 60*b* and the mating segments 42 of a second differential pair of the two adjacent differential pairs is routed under the ground bus 60*b*. Routing of a differential pair either over or under the ground bus 60*b* is accomplished by jogs 66 of the mating segments 42 of the signal contacts 16*a* that offset the mating segments 42 of the signal contacts 16*a* from the ground bus 60*b*.

The receptacle connector 10 is not limited to the pattern of the mating segments 42 of alternating differential pairs of the signal contacts 16*a* being routed over and under the ground bus 60*b* as shown herein and described above. Rather, all of the mating segments 42 of the signal contacts 16*a* could be routed over the ground bus 60*b*, all of the mating segments 42 of the signal contacts 16*a* could be routed under the ground bus 60*b*, or a different pattern of the mating segments 42 of the signal contacts 16*a* could be routed over and under the ground bus 60*b*. The alternating pattern of the mating segments 42 of the signal contacts 16*a* over and under the ground bus 60*b* may improve the electrical performance of the receptacle connector 10, such as, but not limited to, by reducing the occurrence of electrical coupling between adjacent differential pairs of the signal contacts 16*a* and/or the like.

Figure 6:
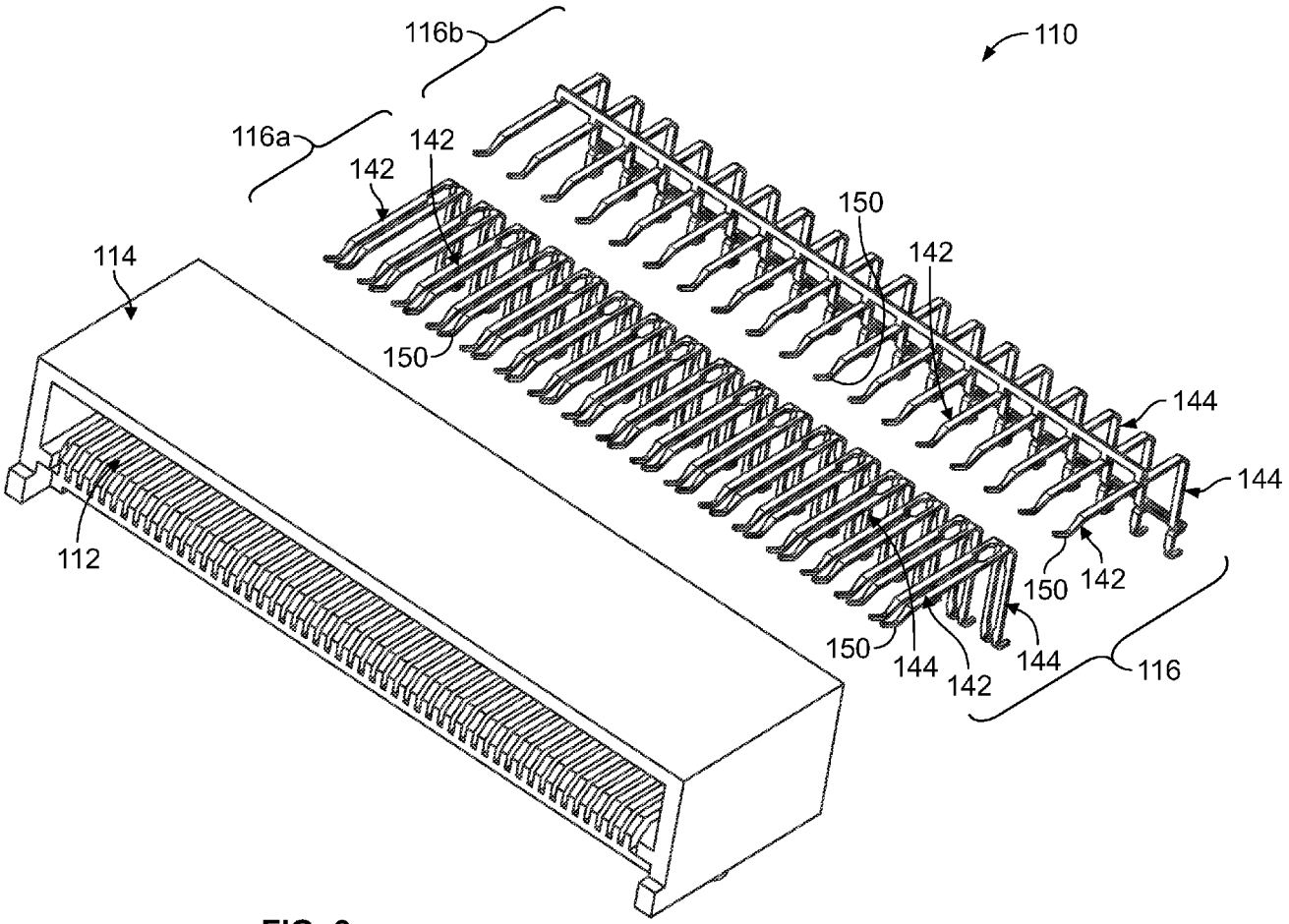
FIG. 6 is an exploded perspective view of a portion of another embodiment of a receptacle connector.

FIG. 6 is an exploded perspective view of a portion of another embodiment of a receptacle connector 110. The receptacle connector 110 includes a housing 114 having a slot 112. The receptacle connector 110 includes a group of contacts 116 and another group of contacts (not shown; e.g., similar to the contacts 18 shown in FIG. 1). The contacts 116 are held directly by the housing 114 and include mating segments 142 and mounting segments 144. The mating segments 142 of the contacts 116 include mating interfaces 150 that are exposed within the slot 112 for engagement with corresponding contacts (not shown) of a mating connector (not shown). The group of contacts 116 optionally may be considered a contact overmolded sub-assembly of the receptacle connector 110 (e.g., when a carrier (not shown) is molded over the contacts 116).

The receptacle connector 110 may include any number of the contacts 116. The contacts 116 include signal contacts 116*a* and ground contacts 116*b*. In the illustrated embodiment of the contacts 116, the signal contacts 116*a* are arranged in pairs with each signal contact 116*a* within a pair conveying a differential signal, thus defining one or more differential pairs. Within the arrangement of the contacts 116, one or more ground contacts 116*b* are provided between adjacent differential pairs of signal contacts 116*a*. Any other contact arrangement of the contacts 116 may be provided. The mating segments 142 and the mounting segments 144 of the signal contacts 116*a* may be referred to herein as "signal mating segments" and "signal mounting segments", respectively. The mating segments 142 and the mounting segments 144 of the ground contacts 116*b* may be referred to herein as "ground mating segments" and "ground mounting segments", respectively. The mating interfaces 150 of the signal contacts 116*a* and the ground contacts 116*b* may be referred to herein as "signal mating interfaces" and "ground mating interfaces", respectively.

Figure 7:
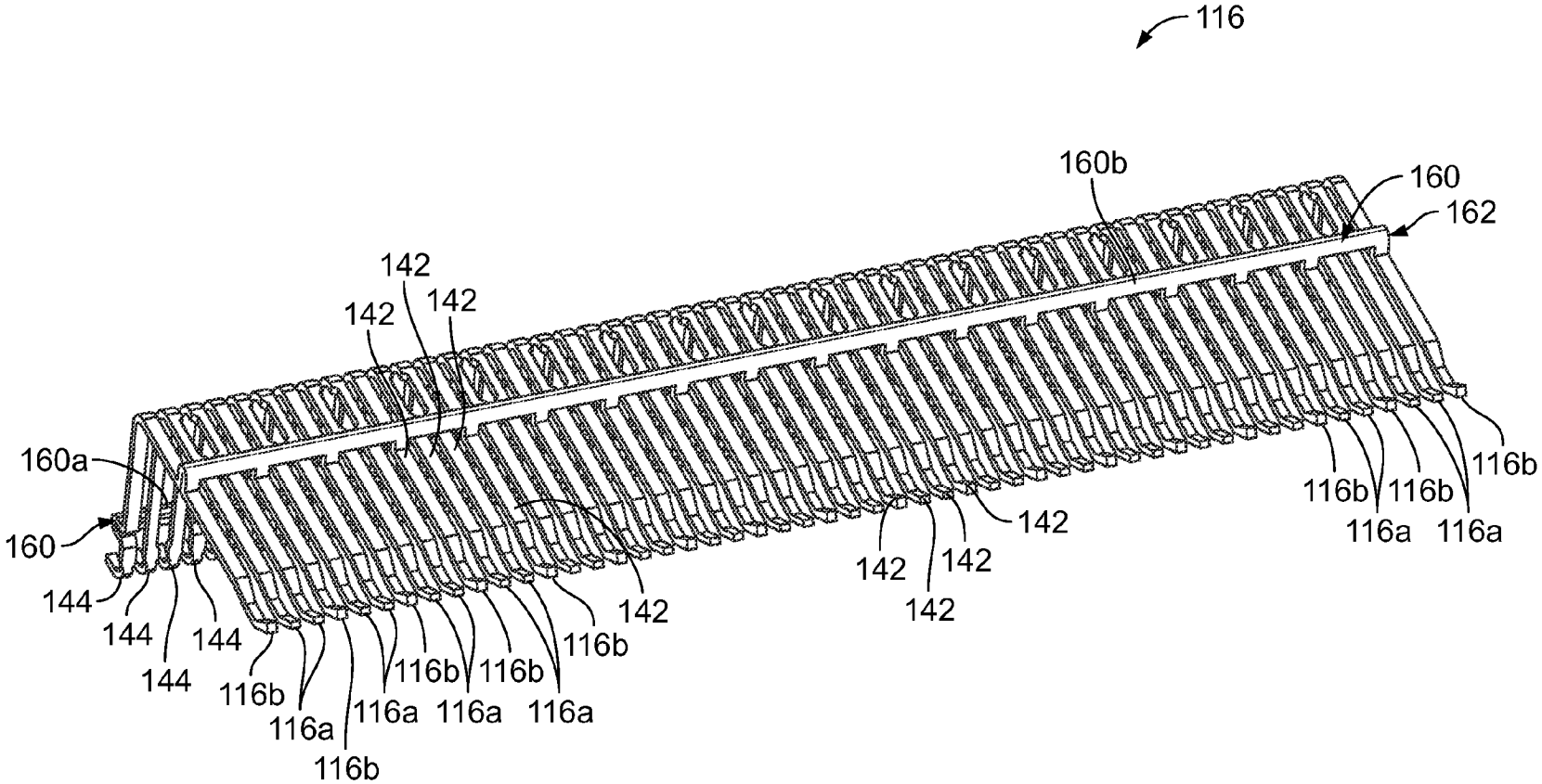
FIG. 7 is a perspective view of an embodiment of an assembly of a group of contacts of the receptacle connector shown in FIG. 6.
Figure 8:
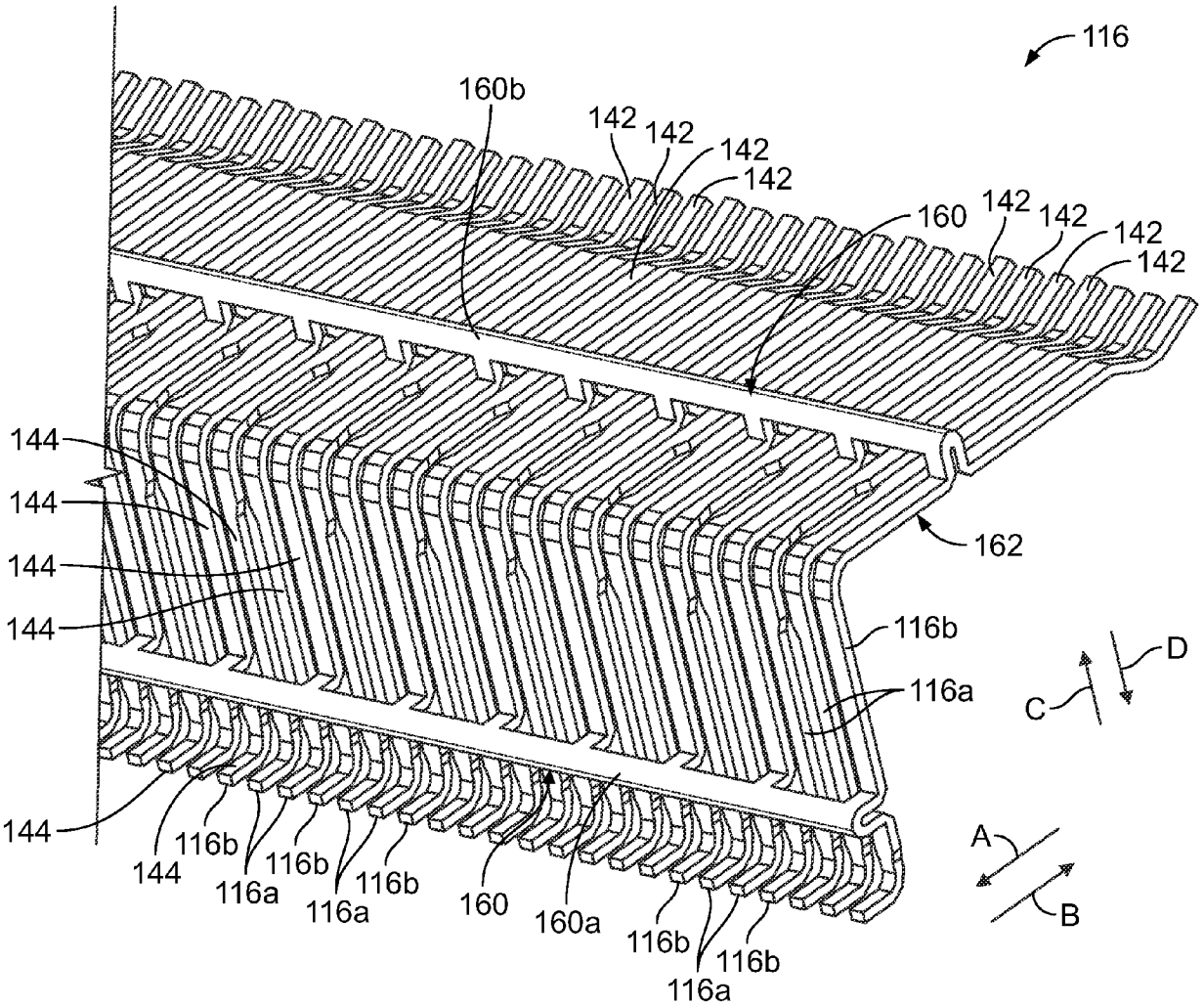
FIG. 8 is a perspective view of a portion of the assembly of the group of contacts shown in FIG. 7.

FIG. 7 is a perspective view of an embodiment of an assembly of the contacts 116 of the receptacle connector 110 (shown in FIG. 6). FIG. 8 is a perspective view of a portion of the assembly of the contacts 116. Only some of the contacts 116 are shown in FIG. 8 for clarity. Referring now to FIGS. 7 and 8, the signal contacts 116*a* are arranged in the differential pairs. In the illustrated embodiment of the contacts 116, a single ground contact 116*b* is provided between adjacent differential pairs of the signal contacts 116*a* such that the contacts 116 have a ground-signal-signal-ground-signal-signal-ground (G-S-S-G-S-S-G) pattern of the contacts 116. But, any number of ground contacts 116*b* may extend between adjacent differential pairs of the signal contacts 116*a*.

One or more ground buses 160 are provided to electrically common the ground contacts 116*b* with each other. In other words, each ground bus 160 provides a continuous electrical pathway from any one ground contact 116*b* to all other ground contacts 116*b*. In the illustrated embodiment of the contacts 116, two ground buses 160*a* and 160*b* are provided. But, any other number of ground buses 160 may be provided. In some embodiments, only a single ground bus 160 (e.g., the ground bus 160*a* or the ground bus 160*b*) is provided.

The ground bus 160*a* extends between, and thereby interconnects, the mounting segments 144 of the ground contacts 116*b* such that the ground bus 160*a* electrically commons the mounting segments 144 of the ground contacts 116*b* to each other. In other words, the ground bus 160*a* extends from the mounting segment 144 of any one ground contact 116*b* to the mounting segment 144 of each adjacent ground contact 116*b*. In the illustrated embodiment of the ground contacts 116*b*, the ground bus 160*a* extends between, and thereby interconnects, the mounting segments 144 of each of the ground contacts 116*b*, as can be seen in FIG. 7. In other embodiments, the ground bus 160*a* extends between, and thereby interconnects, the mounting segments 144 of only some of the ground contacts 116*b*.

In addition or alternative to the illustrated location of the ground bus 160*a* along the lengths of the mounting segments 144 of the ground contacts 116*b*, the ground bus 160*a* may extend at any other location(s) along the lengths of the mounting segments 144 of the ground contacts 116*b*. In the illustrated embodiment of the ground bus 160*a*, the ground bus 160*a* is an approximately straight bar that extends approximately perpendicular to the lengths of the mounting segments 144 of the ground contacts 116*b*. But, the ground bus 160*a* may not be approximately straight and/or the ground bus 160*a* additionally or alternatively (to the perpendicular angle shown herein) may extend at any other angle relative to the lengths of the mounting segments 144 of the ground contacts 116*b*. The ground bus 160*a* may be referred to herein as a "first" and/or a "second" ground bus.

The ground bus 160*a* may improve the electrical performance of the receptacle connector 110. For example, the ground bus 160*a* may reduce the occurrence of undesirable resonant frequency noise spikes, may cancel and/or reduce signal noise, may improve inter-pair signal skew, may match and/or provide a predetermined impedance, and/or the like.

The ground bus 160*b* extends between, and thereby interconnects, the mating segments 142 of the ground contacts 116*b* (i.e., the ground bus 160*b* extends from the mating segment 142 of any one ground contact 116*b* to the mating segment 142 of each adjacent ground contact 116*b*) such that the ground bus 160*b* electrically commons the mating segments 142 of the ground contacts 116*b* to each other. In the illustrated embodiment of the ground contacts 116*b*, the ground bus 160*b* extends between, and thereby interconnects, the mating segments 142 of each of the ground contacts 116*b*. But, in other embodiments, the ground bus 160*b* extends between, and thereby interconnects, the mating segments 142 of only some of the ground contacts 116*b*.

In addition or alternative to the illustrated location of the ground bus 160*b* along the lengths of the mating segments 142 of the ground contacts 116*b*, the ground bus 160*b* may extend at any other location(s) along the lengths of the mating segments 142 of the ground contacts 116*b*. In the illustrated embodiment of the ground bus 160*b*, the ground bus 160*b* is an approximately straight bar that extends approximately perpendicular to the lengths of the mating segments 142 of the ground contacts 116*b*. But, the ground bus 160*b* may not be approximately straight and/or the ground bus 160*b* additionally or alternatively (to the perpendicular angle shown herein) may extend at any other angle relative to the lengths of the mating segments 142 of the ground contacts 116*b*. The ground bus 160*b* may be referred to herein as a "first" and/or a "second" ground bus.

The ground bus 160*b* may improve the electrical performance of the receptacle connector 110. For example, the ground bus 160*b* may reduce the occurrence of undesirable resonant frequency noise spikes, may cancel and/or reduce signal noise, may improve inter-pair signal skew, may match and/or provide a predetermined impedance, and/or the like.

The ground contacts 116*b* and the ground buses 160*a* and 160*b* are integrally fabricated from the same sheet of material as a single, unitary, continuous structure such that the ground contacts 116*b* and the ground buses 160*a* and 160*b* define a single, unitary lead frame 162. One example of a process for integrally fabricating the ground contacts 116*b* and the ground buses 160*a* and 160*b* from the same sheet of material as a continuous structure includes cutting the ground contacts 116*b* and the ground buses 160*a* and 160*b* from a sheet of material and forming the cut structure into the finished shape of the lead frame 162 shown herein. Any cutting process(es) may be used to fabricate the lead frame 162 as a cut and formed lead frame, such as, but not limited to, stamping, laser cutting, water cutting, plasma cutting, cutting using a cutting tool (e.g., a saw, a blade, and/or the like), and/or the like. Moreover, any forming process(es) may be used to fabricate the lead frame 162 as a cut and formed lead frame, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the lead frame 162 is a stamped and formed lead frame that is stamped from a sheet of material. In such embodiments wherein the lead frame 162 is a stamped and formed lead frame, any other type and/or number of forming methods optionally may be used in addition to the stamping process(es) to fabricate the lead frame 162 as a stamped and formed lead frame 162.

Integrally fabricating the ground contacts 116*b* and the ground buses 160*a* and 160*b* from the same sheet of material as a single, unitary, continuous structure, for example using a cutting and forming process, eliminate a separable interface between the ground contacts 116*b* and the ground buses 160*a* and 160*b*, which may enable greater control of the mating normal force between the receptacle connector 110 and the mating connector. Moreover, eliminating a separable interface between the ground contacts 116*b* and the ground buses 160*a* and 60*b* may improve the reliability of the receptacle connector 110.

Figure 9:
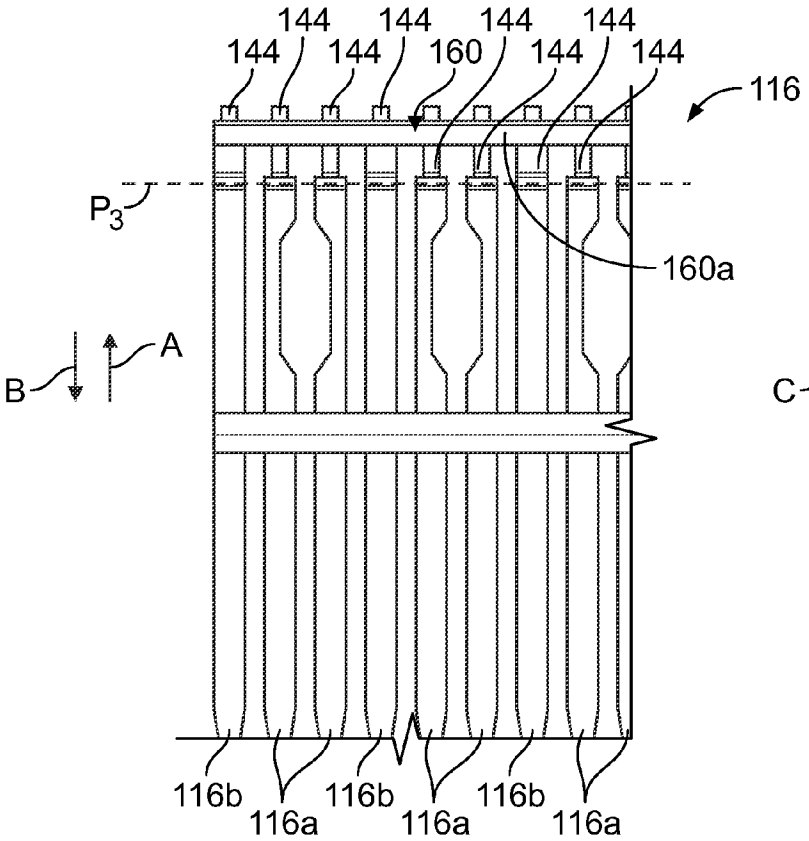
FIG. 9 is a plan view of a portion of the assembly of the group of contacts shown in FIG. 7.

FIG. 9 is a plan view of a portion of the assembly of the group of contacts 116. Referring now to FIGS. 8 and 9, in the illustrated embodiment, the mounting segments 144 of the signal contacts 116*a* are arranged in approximately the same plane $P_3$ (not labeled in FIG. 8) as the mounting segments 144 of the ground contacts 116*b*, as can be seen in FIGS. 8 and 9. The ground bus 160*a* is offset from the mounting segments 144 of the signal contacts 116*a* to prevent the signal contacts 116*a* from electrically shorting with the ground bus 160*a*. Specifically, the ground bus 160*a* is offset from the plane $P_3$ of the mounting segments 144. In the illustrated embodiment, the ground bus 160*a* is offset from the plane $P_3$ of the mounting segments 144 in the direction of the arrow A. But, the ground bus 160*a* additionally or alternatively may be offset from the plane $P_3$ of the mounting segments 144 in the direction of the arrow B.

Figure 10:
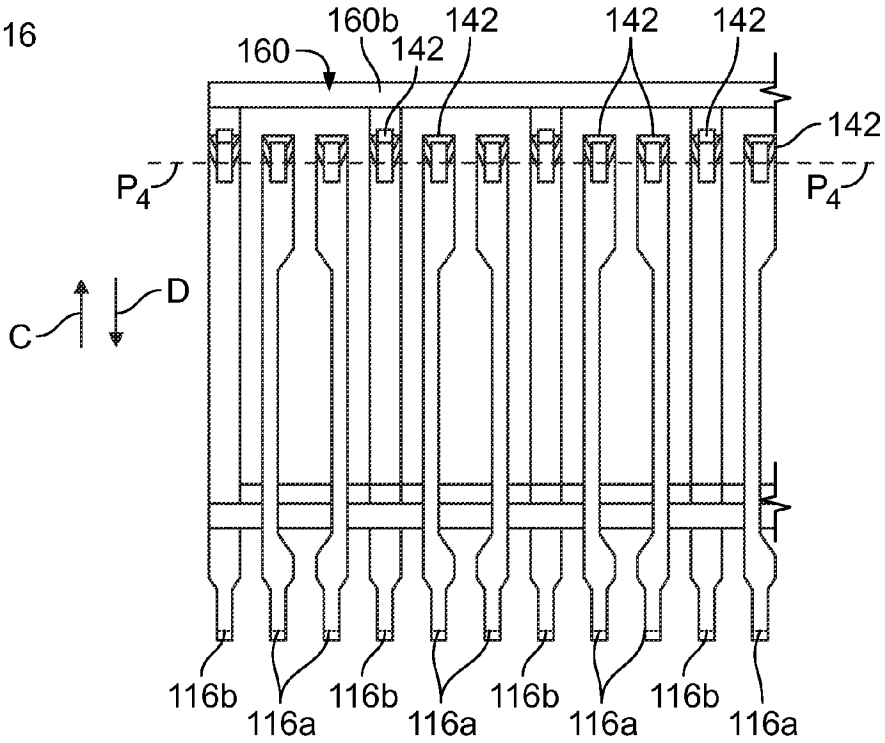
FIG. 10 is an elevational view of a portion of the assembly of the group of contacts shown in FIG. 7.

FIG. 10 is an elevational view of a portion of the assembly of the group of contacts 116. Referring now to FIGS. 8 and 10, in the illustrated embodiment, the mating segments 142 of the signal contacts 116*a* are arranged in approximately the same plane $P_4$ (not labeled in FIG. 8) as the mating segments 142 of the ground contacts 116*b*, as can be seen in FIGS. 8 and 10. The ground bus 160*b* is offset from the mating segments 142 of the signal contacts 116*a* to prevent the signal contacts 116*a* from electrically shorting with the ground bus 160*b*. More particularly, the ground bus 160*b* is offset from the plane $P_4$ of the mating segments 142. In the illustrated embodiment, the ground bus 160*b* is offset from the plane $P_4$ of the mating segments 142 in the direction of the arrow C. But, the ground bus 160*b* additionally or alternatively may be offset from the plane $P_4$ in the direction of the arrow D.

The embodiments described and/or illustrated herein may provide a receptacle connector having an improved electrical performance. The embodiments described and/or illustrated herein may enable greater control of the mating normal force between a receptacle connector and a mating connector, for example as compared to at least some known receptacle connectors. The embodiments described and/or illustrated herein may provide a receptacle connector that is more reliable.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector comprising:

a housing comprising a slot configured to receive a mating connector therein;

signal contacts held by the housing, the signal contacts comprising signal mating segments and signal mounting segments, the signal mating segments comprising signal mating interfaces that are exposed within the slot for engagement with the mating connector;

ground contacts held by the housing, the ground contacts comprising ground mating segments and ground mounting segments, the ground mating segments comprising ground mating interfaces that are exposed within the slot for engagement with the mating connector, wherein the ground contacts are arranged in approximately the same plane as the signal contacts; and a ground bus that electrically commons the ground contacts with each other, wherein two or more ground contacts and the ground bus are integrally fabricated as a single, unitary, continuous structure, the signal contacts comprising jogs that offset the signal contacts from the ground bus.

2. The receptacle connector of claim 1, wherein the ground bus extends between the ground mating segments of the ground contacts such that the ground bus electrically commons the ground mating segments.

3. The receptacle connector of claim 1, wherein the ground bus extends between the ground mounting segments of the ground contacts such that the ground bus electrically commons the ground mounting segments.

4. The receptacle connector of claim 1, wherein the ground bus is a first ground bus that electrically commons the ground mating segments of the ground contacts, the receptacle connector comprising a second ground bus that electrically commons the ground mounting segments of the ground contacts, the second ground bus and the ground contacts being integrally fabricated as a single, unitary, continuous structure.

5. The receptacle connector of claim 1, wherein the signal contacts are arranged in differential pairs, and wherein alternating differential pairs are routed over and under the ground bus.

6. The receptacle connector of claim 1, wherein the signal contacts are arranged in differential pairs, a first differential pair of the signal contacts being routed over the ground bus, a second differential pair of the signal contacts that is adjacent the first differential pair being routed under the ground bus.

7. The receptacle connector of claim 1, wherein the signal mating segments of the signal contacts are arranged in approximately the same plane as the ground mating segments of the ground contacts, the signal mating segments comprising jogs that offset the signal mating segments from the ground bus.

8. The receptacle connector of claim 1, wherein the signal mounting segments of the signal contacts are arranged in approximately the same plane as the ground mounting segments of the ground contacts, the signal mounting segments comprising jogs that offset the signal mounting segments from the ground bus.

9. The receptacle connector of claim 1, wherein the signal contact and the ground contacts are held by a common dielectric carrier that is held by the housing.

10. A receptacle connector comprising:

a housing comprising a slot configured to receive a mating connector therein;

signal contacts held by the housing, the signal contacts comprising signal mating segments and signal mounting segments, the signal mating segments comprising signal mating interfaces that are exposed within the slot for engagement with the mating connector;

ground contacts held by the housing, the ground contacts comprising ground mating segments and ground mounting segments, the ground mating segments comprising ground mating interfaces that are exposed within the slot for engagement with the mating connector;

a first ground bus that electrically commons the ground mating segments of the ground contacts with each other, wherein the ground mating segments of two or more ground contacts and the first ground bus are integrally fabricated as a single, unitary, continuous structure; and a second ground bus that electrically commons the ground mounting segments of the ground contacts with each other, wherein the ground mounting segments of two or more ground contacts and the second ground bus are integrally fabricated as a single, unitary, continuous structure.

11. The receptacle connector of claim 10, wherein the signal contacts are arranged in differential pairs, the signal mating segments of alternating differential pairs being routed over and under the first ground bus, the signal mounting segments of alternating differential pairs being routed over and under the second ground bus.

12. The receptacle connector of claim 10, wherein the signal contacts are arranged in differential pairs, the signal mating segments of a first differential pair of the signal contacts being routed over the first ground bus, the signal mating segments of a second differential pair of the signal contacts that is adjacent the first differential pair being routed under the first ground bus.

13. The receptacle connector of claim 10, wherein the signal contacts are arranged in differential pairs, the signal mounting segments of a first differential pair of the signal contacts being routed over the second ground bus, the signal mounting segments of a second differential pair of the signal contacts that is adjacent the first differential pair being routed under the second ground bus.

14. The receptacle connector of claim 10, wherein the signal mating segments of the signal contacts are arranged in approximately the same plane as the ground mating segments of the ground contacts, the signal mating segments comprising jogs that offset the signal mating segments from the first ground bus, the signal mounting segments comprising jogs that offset the signal mounting segments from the second ground bus.

15. The receptacle connector of claim 10, wherein the signal mating segments of the signal contacts are arranged in approximately the same plane as the ground mating segments of the ground contacts, the first ground bus comprising an approximately straight bar that is offset from the signal and ground mating segments.

16. The receptacle connector of claim 10, wherein the signal mounting segments of the signal contacts are arranged in approximately the same plane as the ground mounting segments of the ground contacts, the second ground bus comprising an approximately straight bar that is offset from the signal and ground mounting segments.

17. A receptacle connector comprising:

a housing comprising a slot configured to receive a mating connector therein;

signal contacts held by the housing, the signal contacts being arranged in differential pairs, the signal contacts comprising signal mating segments and signal mounting segments, the signal mating segments comprising signal mating interfaces that are exposed within the slot for engagement with the mating connector;

ground contacts held by the housing, the ground contacts comprising ground mating segments and ground mounting segments, the ground mating segments comprising ground mating interfaces that are exposed within the slot for engagement with the mating connector; and a ground bus that electrically commons the ground contacts with each other, wherein the ground contacts and the ground bus are integrally fabricated as a single, unitary, continuous structure, and wherein alternating differential pairs of the signal contacts are routed over and under the ground bus.

18. The receptacle connector of claim 17, wherein the signal contacts comprise jogs that route the signal contacts over and under the ground bus.

19. The receptacle connector of claim 17, wherein the signal mating segments of the signal contacts are arranged in approximately the same plane as the ground mating segments of the ground contacts, the ground bus comprising an approximately straight bar that is offset from the signal and ground mating segments.

20. The receptacle connector of claim 17, wherein the signal mounting segments of the signal contacts are arranged in approximately the same plane as the ground mounting segments of the ground contacts, the ground bus comprising an approximately straight bar that is offset from the signal and ground mounting segments.

* * * * *